United States Patent [19]

Loeb

[11] 4,249,589

[45] Feb. 10, 1981

[54] APPARATUS FOR MOUNTING AN ENVIRONMENT CONTROLLING SHEET

[76] Inventor: Nackey S. Loeb, Prides Crossing, Mass. 01965

[21] Appl. No.: 70,925

[22] Filed: Aug. 30, 1979

Related U.S. Application Data

[63] Continuation of Ser. No. 932,269, Aug. 9, 1978, abandoned.

[51] Int. Cl.[3] ..... E06B 3/00

[52] U.S. Cl. ..... 160/368 R; 160/354

[58] Field of Search ..... 160/90, 354, 368 R, 160/369, 371

[56] References Cited

U.S. PATENT DOCUMENTS

| | | | |
|---|---|---|---|
| 933,975 | 9/1909 | Graupner | 160/368 R |
| 1,516,246 | 11/1924 | Reagan | 160/368 R |
| 1,902,949 | 3/1933 | Condon | 160/369 |
| 2,017,539 | 10/1935 | Kaplan | 160/368 R |
| 2,925,862 | 2/1960 | Sundby | 160/354 |
| 3,753,458 | 8/1973 | Lazarek | 160/354 |
| 4,103,728 | 8/1978 | Burdette et al. | 160/368 R |

*Primary Examiner*—Peter M. Caun

[57] ABSTRACT

Apparatus for mounting an environment controlling screen, sheet or membrane, is provided comprising separate frame sections secured in mutually abutting relation to the inner periphery of an opening, mutually abutting strip of Velcro hook material are affixed to each frame section, and a flexible sheet, dimensioned to fit the frame section, is affixed to the frame section by means of a strip of Velcro pile material attached to the margins of the sheet. A mosquito-proof joint is provided by the abutting Velcro material even though the frame sections are not joined directly one to the other. Quick installation and removal of the sheet material is feasible. Storage of the sheets is convenient, simple, and takes up little space.

1 Claim, 4 Drawing Figures

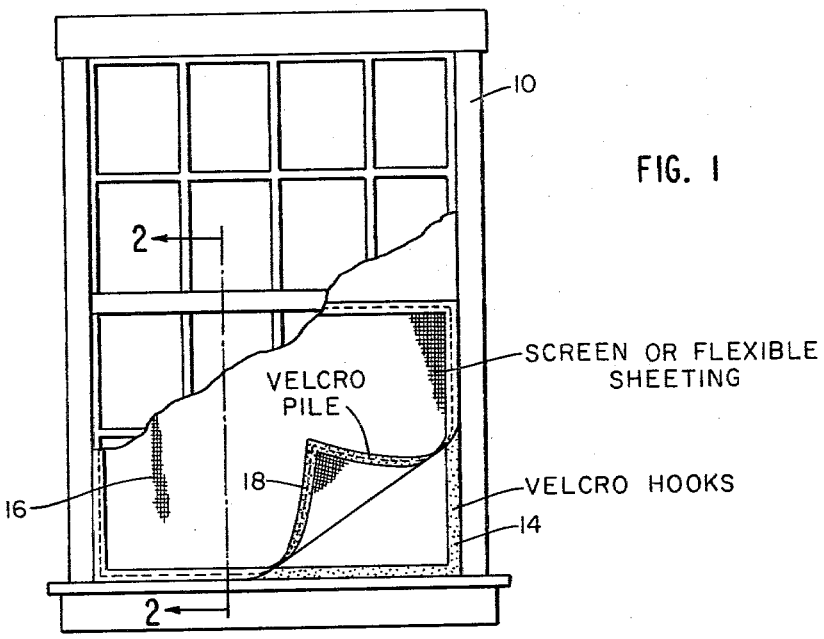
FIG. 1
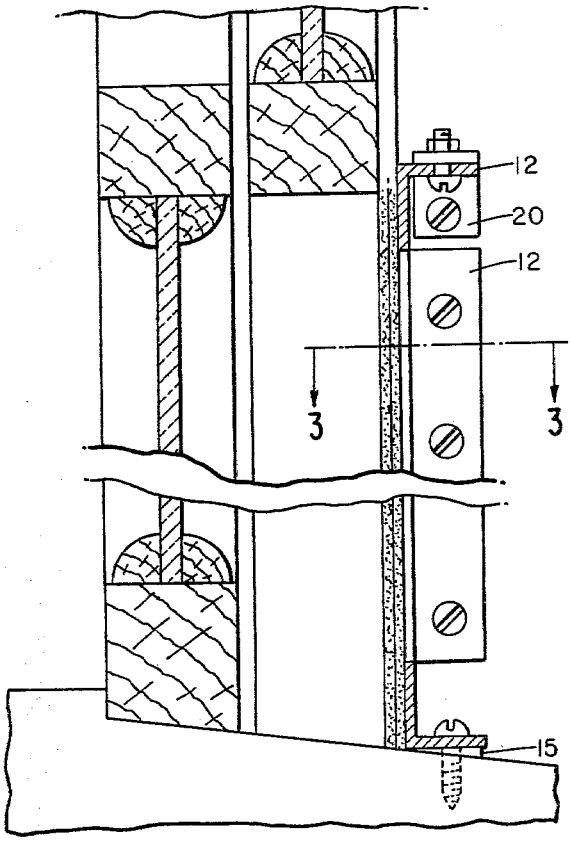
FIG. 2
FIG. 3
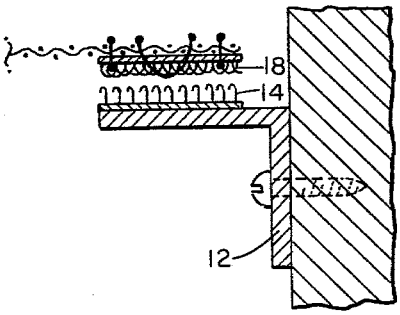
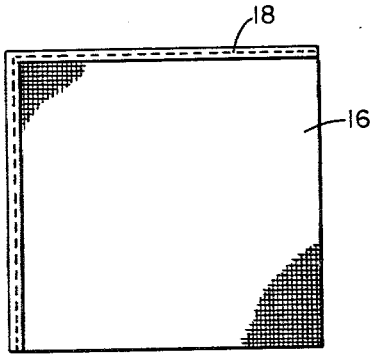
FIG. 4

APPARATUS FOR MOUNTING AN ENVIRONMENT CONTROLLING SHEET

This is a continuation of application Ser. No. 932,269 filed Aug. 9, 1978, now abandoned.

FIELD OF THE INVENTION

This invention relates to window screens and other permeable or impermeable, transparent or translucent members for use in conjunction with windows, doors, vents or other openings through walls for the purpose of controlling the passage of environmental elements therethrough. More particularly, this invention relates to thin, flexible environment controlling materials and means for mounting them in windows, doors and the like for easy installation and removal. In a specific embodiment, the invention relates to a "do-it-yourself" kit for quick installation or removal of screens and storm windows.

BACKGROUND OF THE INVENTION

In temperate climates, as the seasons change, it often becomes desireable to change the nature of components employed in windows, doors and the like for controlling the passage of heat, air, dust, insects, etc. from the outside into the interior of buildings and dwellings or vice versa. Thus, during winter, extra thermal insulation is usually desireable and storm windows or "thermopane" windows are usually placed over the ordinary windows. Conversely, in the milder seasons free circulation of air through windows and doors is usually desireable, and in order to provide same without simultaneously allowing access to insects which are prevalent during such seasons, screens or permeable membranes are substituted for storm windows, doors, etc.

The problem to which the present invention is directed is that of changing from one form of environment controlling barrier to another. Conventionally storm windows (or doors) and window screens (or door screens) have been separate items each having its own supporting frame and each being more or less permanently secured thereto. Changing from one form of environment controlling element to the other, required complete removal of one, placing it in storage, and then removing the other from storage and installing it. In many cases the frames were large and cumbersome and required installation from the outside. Often a ladder was required, and even on mildly windy days, transporting a large storm window to the top of a ladder would be difficult and hazardous. In recent years various forms of extruded metal frames have come on the market, in which separate storm window and screen sections have been slidably mounted on individual, smaller sub-frames. In this way, an installation could have upper and lower storm window sections to provide complete storm window protection during winter. In addition a screen section for the lower part of the window could be provided. With such an arrangement the screen remains in the frame all year round. During winter it is slid to the up position and the lower storm window section is slid down. During summer, the respective positions of the latter two sections are reversed. Although leaving the screens and storm windows up permanently as one may do with such an arrangement, avoids the nuisance of removal, storage and exchange, it is far from a happy solution. The screen collects dirt or dust, and it impairs the passage of light even when clean. Its presence likewise impedes window washing.

Accordingly, an object of the present invention is to provide a simple, inexpensive and convenient way to mount an environment controlling barrier in at least a portion of a passage into a dwelling or the like whereby the barrier may be quickly installed or removed and replaced, and whereby transportation to and from storage is simple and convenient.

Another object is to provide a simple "do it yourself" kit for installing storm windows, screens, or other impervious or semi-impervious sheet material in access passages to dwellings or the like.

BRIEF DESCRIPTION OF THE INVENTION

In the accomplishment of these and other objects in a preferred embodiment of the invention, an environment controlling barrier is provided for access passages into dwellings such as windows, doors and the like, comprising separate frame sections lining the inside perimeter of at least a portion of the passage. The frame sections have secured to them strips of Velcro hook material which consists essentially of an elongated flexible base in which are embedded the bases of a multiplicity of small hooks. The Velcro hook strips about each other and extend around the full perimeter of the frame. The environment controlling barrier comprises a flexible sheet which may be a screen, a transparent plastic sheet, or a porous membrane of paper or the like (as used in Japanese dwellings). The sheet has a strip of Velcro pile material attached to its margin. The sheet is dimensioned to coincide with and overlap the frame sections so that it can be placed in position simply by pushing the Velcro pile material against the Velcro hook material. Removal is done by peeling off the sheet starting at one corner. The arrangement provides for alternate installation of sheets serving as screens, storm windows, and translucent porous membranes, for quick removal and replacement of same, and for easy storage thereof.

In one embodiment a kit is provided in which the frame sections and sheet materials are cut to standard lengths but are adapted for easy trimming to fit the dimensions of individual passages of smaller dimension.

DESCRIPTION OF THE DRAWINGS

The preferred embodiment of the invention herein described is illustrated in the accompanying drawings in which FIG. 1 is a view in front elevation, from the inside, of a conventional window showing the environment controlling barrier of the present invention in the installed position;

FIG. 2 is a side view in partial cross-section taken along the lines 2—2 of FIG. 1;

FIG. 3 is a plan view in partial cross-section taken along the lines 3—3 of FIG. 2; and FIG. 4 is a view of the sheet material as provided in the "do it yourself" kit of the invention, prior to trimming same.

DETAILED DESCRIPTION OF THE INVENTION

The preferred embodiment of the invention herein shown provides an environment controlling barrier for passages into dwellings or the like such as a window 10. The base element comprises a frame made up of extruded aluminum angle sections 12 having a pair of flanges, and being cut longitudinally to fit the inner perimeter of the portion of the passage or opening which is intended to be covered. A strip of Velcro hook material 14 is secured (preferably by permanent adhesive) to the outside of one flange of the angle section 12. The other flange is perforated to receive screws for attaching the angle sections to the perimeter of the opening. The Velcro hook material 14 comprises an elongated base into which a multiplicity of small hooks are embedded.

The environment controlling barrier comprises a flexible sheet 16 which may be a screen, a transparent impervious sheet, or a porous translucent sheet dimensioned to coincide with marginally overlap the frame sections 12. A strip of Velcro pile material 18, comprising an elongated fabric backer with a fibrous pile attached thereto is affixed by sewing, stapling and/or adhesive to the margin of the sheet 16 in position to be pushed into locking engagement with the Velcro hook material 14.

Employing these components, installation, removal and storage of an environment controlling barrier are simple and convenient. First, the frame sections 12 are cut to fit the opening to be covered. Next the frame sections 12 are secured to the perimeter of the opening (using wedges 15 for levelling purposes where needed) with the Velcro hook material 14 facing inwardly. In cases where a frame section 12 must cross the opening, a pair of brackets 20 are provided for attachment to the ends of the frame section 12 at each side of the opening. The frame sections 12 are then bolted to brackets 20. Once the frame is secured in place, and the sheet material 16 properly dimensioned to fit the frame, with its Velcro pile strip 18 attached to the margin of sheet 16, all that is needed is to put it in place and gently push the Velcro pile onto the Velcro hooks. Removal is just as easy. Starting at one corner, the sheet is bent and the Velcro peels off with ease. The sheets are light, take up very little room and can be stored flat or rolled up.

In one embodiment a "do it yourself" kit is provided in which four frame sections 12 of standard maximum lengths are included. In addition, a pair of brackets 20, associated screens, nuts, bolts, and leveling wedges as well as a set of screens 16 are provided. The screens 16 each have a strip of Velcro pile material 18 affixed to two adjoining margins. Additional Velcro pile material is also provided, having a heat resistant pressure sensitive adhesive film on one surface thereof. With these components, the frame members must first be trimmed to fit the opening, after which they are installed as above described. Next, the margins of the screen 16 which do not have the Velcro pile on them are trimmed so that the entire screen fits the opening. Next, the Velcro pile strip with pressure sensitive adhesive backer is attached to the so-trimmed margins of the sheet. Additional measures for affixing the Velcro pile to the margins of the sheet can be taken at this time as by stapling or sewing. Once the sheet 16 has been so prepared it is ready for installation.

As may be seen in FIGS. 1, 2 and 3, the four separate frame sections 12 have a base material carrying Velcro hooks attached to one flange along the full length and width thereof. A separate frame section 12 is mounted at the base of a double sashed window as shown with its Velcro hook carrying flange facing inwardly and lying adjacent to the plane of the outermost sash. Two side frame sections 12 are similarly mounted and abut the section at the base with the edges of the Velcro material on each section abutting the other to provide a mosquito-proof joint even though the frame sections are not themselves joined one directly to the other. The fourth frame section 12 is similarly mounted across the window frame with its Velcro carrying flange facing inwardly and with the Velcro thereof abutting that of the side frame sections 12. The sheet 16 with Velcro pile material affixed to its margins is then pressed onto the frame with the inner upper margin of sheet 16 lying in abutting relation with the lower outer edge of the outermost sash.

Various modifications of the preferred embodiment will now be apparent to those skilled in the art and therefore it is not intended to confine the invention to the precise form herein shown but rather to limit it in terms of the appended claims.

I claim:

1. Apparatus for mounting an environment controlling barrier on a double sashed window frame comprising:

four separate frame sections each of which has an elongated body having a pair of flanges disposed at right angles;

a layer of base material completely covering the outer surface of one flange of each said frame section;

a multiplicity of small hooks embedded in said base material along the full length thereof on each frame section;

separate means for directly securing one frame section to the base of said window frame outside of but adjacent to the plane of the outermost sash and with the hooks facing inwardly;

separate means for directly securing one said frame section at each side of said window frame in abutting relation with the frame section at the base and with the flange thereof having the hooks thereon facing inwardly and likewise lying adjacent to the plane of the outermost sash, and in abutting relation with the base material of the adjacent frame section;

separate means for directly securing the fourth frame section across the window frame at the midpoint thereof in abutting relation with the tops of the frame sections secured to the sides and with the flange having the hooks thereon facing inwardly and likewise lying adjacent to the plane of the outermost sash, and in abutting relation with the base material of the adjacent frame sections;

a flexible environment controlling barrier dimensioned to overlap said frame sections in said window frame;

elongated strips of fibrous pile material affixed to each margin of said barrier;

said pile material in interlocking engagement with said hooks and in abutting relation at the corners formed by said frame sections; and the lower edge of the outermost sash in abutting relation with the inner upper margin of said barrier.

* * * * *